US010648192B2

(12) United States Patent
Rossi

(10) Patent No.: US 10,648,192 B2
(45) Date of Patent: May 12, 2020

(54) FUNERARY STRUCTURE FOR CONTAINING FUNERARY OBJECTS

(71) Applicant: BIONDAN NORTH AMERICA INC., Toronto, Ontario (CA)

(72) Inventor: Filippo Rossi, Isola Della Scala (IT)

(73) Assignee: BIONDAN NORTH AMERICA INC., Toronto, Ontario (CA)

( * ) Notice: Subject to any disclaimer, the term of this patent is extended or adjusted under 35 U.S.C. 154(b) by 0 days.

(21) Appl. No.: 16/120,622

(22) Filed: Sep. 4, 2018

(65) Prior Publication Data

US 2019/0368219 A1 Dec. 5, 2019

(30) Foreign Application Priority Data

May 31, 2018 (IT) ..... 1020185885

(51) Int. Cl.
*E04H 13/00* (2006.01)

(52) U.S. Cl.
CPC ..... *E04H 13/006* (2013.01)

(58) Field of Classification Search
CPC ..... E04H 13/00; E04H 13/006; E04H 13/008; A61G 17/00; A61G 17/08
USPC ..... 27/1, 35; 52/134, 136; 211/85.27
See application file for complete search history.

(56) References Cited

U.S. PATENT DOCUMENTS 2,513,951 A * 7/1950 McClellen ..... E04H 13/006 27/1
3,529,730 A * 9/1970 Thompson ..... E04H 13/006 211/85.27
3,754,805 A * 8/1973 Pangburn ..... E04H 13/006 312/111
3,841,726 A * 10/1974 Andros ..... A47B 47/0041 312/111
4,614,066 A 9/1986 Koppenberg
5,195,812 A * 3/1993 Eickhof ..... A47B 47/0091 312/257.1
5,477,594 A * 12/1995 LePage ..... E04H 13/006 211/194
5,881,505 A * 3/1999 Larkin, III ..... E04H 13/006 211/85.27
5,979,124 A * 11/1999 Branan ..... E04H 13/006 52/134

(Continued)

FOREIGN PATENT DOCUMENTS

FR 2617890 A * 1/1989
KR 1662960 B1 * 10/2016
WO 99/42685 A1 8/1999

OTHER PUBLICATIONS

Italian Search Report dated Jan. 18, 2019 received in Italian Patent Application No. IT201800005885, together with an English-language translation.

*Primary Examiner* — William L Miller
(74) *Attorney, Agent, or Firm* — Scully, Scott, Murphy & Presser, P.C.

(57) ABSTRACT

A funerary structure for containing funerary objects, which comprises a base framework provided with a plurality of profiled elements which are arranged along at least two directions and can be fixed to a supporting wall. The profiled elements delimit laterally at least one containment recess for funerary objects. There is at least one slab for closing the recess, which can be fixed, by virtue of fixing elements, to the base framework on the opposite side with respect to the supporting wall.

12 Claims, 16 Drawing Sheets

(56) References Cited

U.S. PATENT DOCUMENTS

| | | | | |
|---|---|---|---|---|
| 6,105,315 | A * | 8/2000 | Stoecklein | E04H 13/006 27/1 |
| 6,250,025 | B1 * | 6/2001 | Darby | E04H 13/006 52/137 |
| 6,578,323 | B1 * | 6/2003 | Zartman | E04H 13/006 27/1 |
| 7,356,891 | B2 * | 4/2008 | Freeman | E04H 13/006 27/35 |
| 7,415,800 | B2 * | 8/2008 | Stienwand | E04H 13/006 109/68 |
| 7,926,228 | B1 * | 4/2011 | Snow | E04H 13/008 27/35 |
| 9,051,752 | B1 * | 6/2015 | Muthusami | E04H 13/008 |
| 9,777,501 | B2 * | 10/2017 | Rossi | E04H 13/008 |
| 10,138,650 | B1 * | 11/2018 | Garcia | E04H 13/006 |
| 2007/0175110 | A1 * | 8/2007 | Bosisio | E04H 13/006 52/136 |
| 2007/0209172 | A1 | 9/2007 | Krawczyk | |
| 2008/0078074 | A1 * | 4/2008 | McCampbell | E04H 13/006 27/1 |
| 2010/0300016 | A1 * | 12/2010 | Eickhof | E04H 13/006 52/136 |
| 2012/0167488 | A1 * | 7/2012 | Eickhof | E04H 13/006 52/139 |
| 2013/0199111 | A1 * | 8/2013 | Eickhof | E04H 13/006 52/134 |
| 2015/0308141 | A1 * | 10/2015 | Ugartechea Berlanga | A61G 99/00 52/135 |
| 2017/0183889 | A1 * | 6/2017 | Rossi | E04H 13/008 |
| 2018/0202184 | A1 * | 7/2018 | Rossi | E04H 13/008 |
| 2018/0223558 | A1 * | 8/2018 | Birkmeier | E04H 13/008 |

* cited by examiner 3
25
22
20
20c
20b
21
13
15
3
22
14
20a
22
20c
17
11b
21
12a
20a
20a
5
12b
20b
20b
20
20a
11a
20a
3
25
20
20b
15
10a
3
20
14
20c
21
22
17
12a
20b
25
22
20b
12a
13
3
20a
20a
14
20a
21
20c
5
21
3
3
20a
22
15
20
14
22
22
21
22
20b
20b
12a
3
20a

FUNERARY STRUCTURE FOR CONTAINING FUNERARY OBJECTS

CROSS-REFERENCE TO RELATED APPLICATIONS

This Application claims priority to Application IT 102018000005885 filed on May 31, 2018.

BACKGROUND OF THE DISCLOSURE

The present invention relates to a funerary structure for containing funerary objects.

As is known, in cemeteries the need is felt to be able to utilize adequately all the spaces available for the placement of funerary objects, such as coffins, urns, vases, photograph holders, and so forth.

It is usual that in cemeteries characterized by the presence of walls made of masonry or concrete in which the accommodation recesses of funerary objects are provided, closed by stone slabs and arranged usually in stacked horizontal rows, there can be dividing walls which are coupled at right angles to the walls provided with recesses.

These dividing walls are not thick enough to be able to provide the recesses inside them and are too close to the first recesses that are present on the contiguous walls to allow the placement on their surfaces of traditional containment structures formed by boxlike elements made of metal, cement or plastic material and glass arranged in a matrix.

BRIEF SUMMARY OF THE DISCLOSURE

For these reasons, dividing walls are currently an unused space.

The aim of the present invention is to provide a funerary structure for containing funerary objects that is capable of improving the background art in one or more of the aspects indicated above.

Within this aim, an object of the invention is to provide a funerary structure which, by virtue of its particular space occupation characteristics, allows to utilize all the spaces available in cemeteries.

Another object of the invention is to provide a funerary structure that can be assembled easily and rapidly.

A further object is to provide a funerary structure that can be integrated aesthetically within the cemeteries in which it is inserted.

Another object of the present invention is to provide a funerary structure that can be composed freely so as to adapt it to different requirements of use.

A further object of the present invention is to overcome the drawbacks of the background art in a manner that is alternative to any existing solutions.

Another object of the invention is to provide a funerary structure that is competitive also from a purely economic standpoint.

This aim, as well as these and other objects which will become better apparent hereinafter, are achieved by a funerary structure for containing funerary objects according to claim 1, optionally provided with one or more of the characteristics of the dependent claims.

BRIEF DESCRIPTION OF THE SEVERAL VIEWS OF THE DRAWINGS

Further characteristics and advantages of the present invention will become better apparent from the description of a preferred but not exclusive embodiment of the funerary structure for containing funerary objects, according to the invention, illustrated by way of nonlimiting example in the accompanying drawings, wherein.

DETAILED DESCRIPTION OF THE DISCLOSURE

Figure 1:
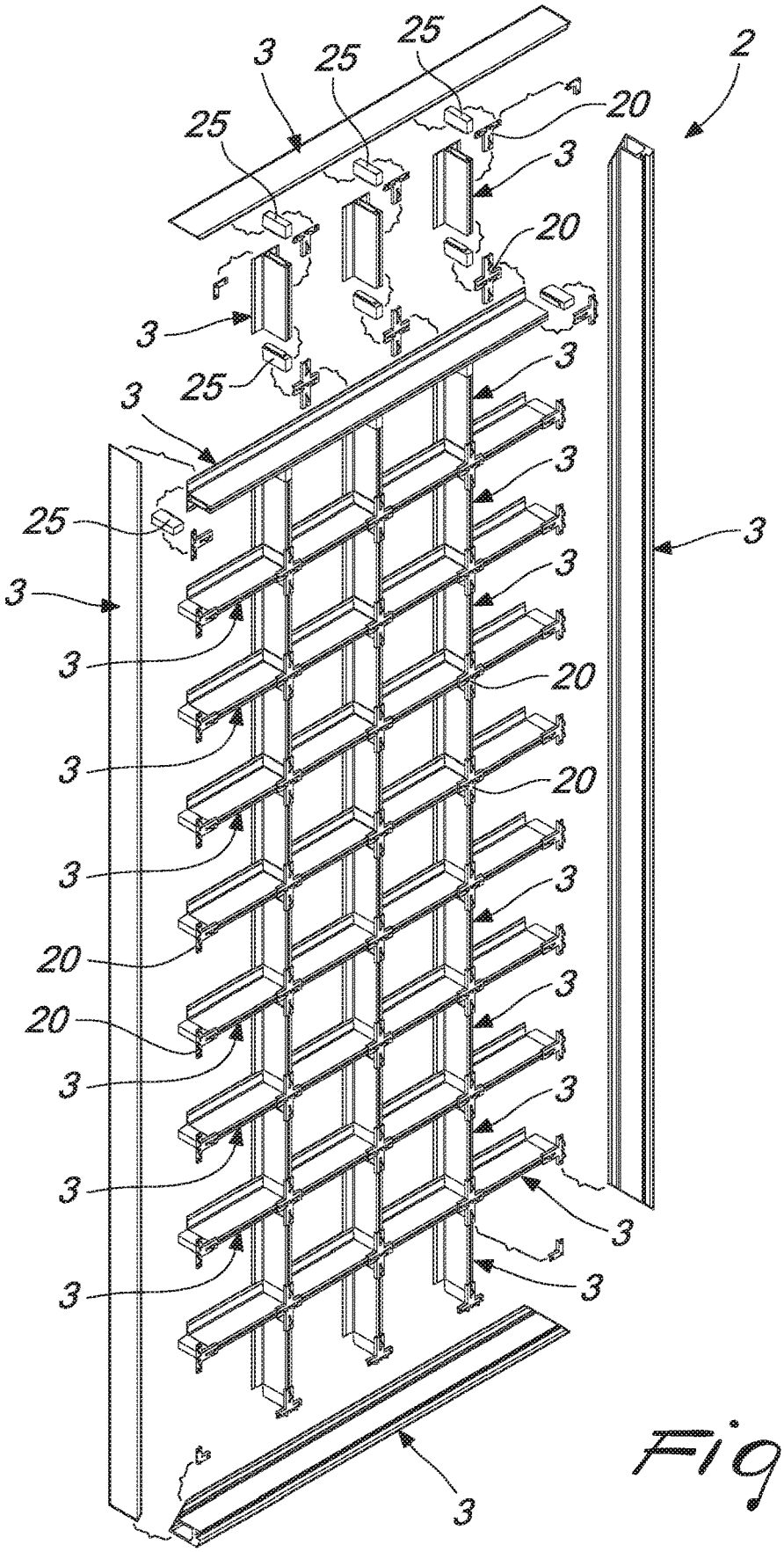
FIG. 1 is a partially exploded perspective view of a base framework of the funerary structure according to the invention.
Figure 2:
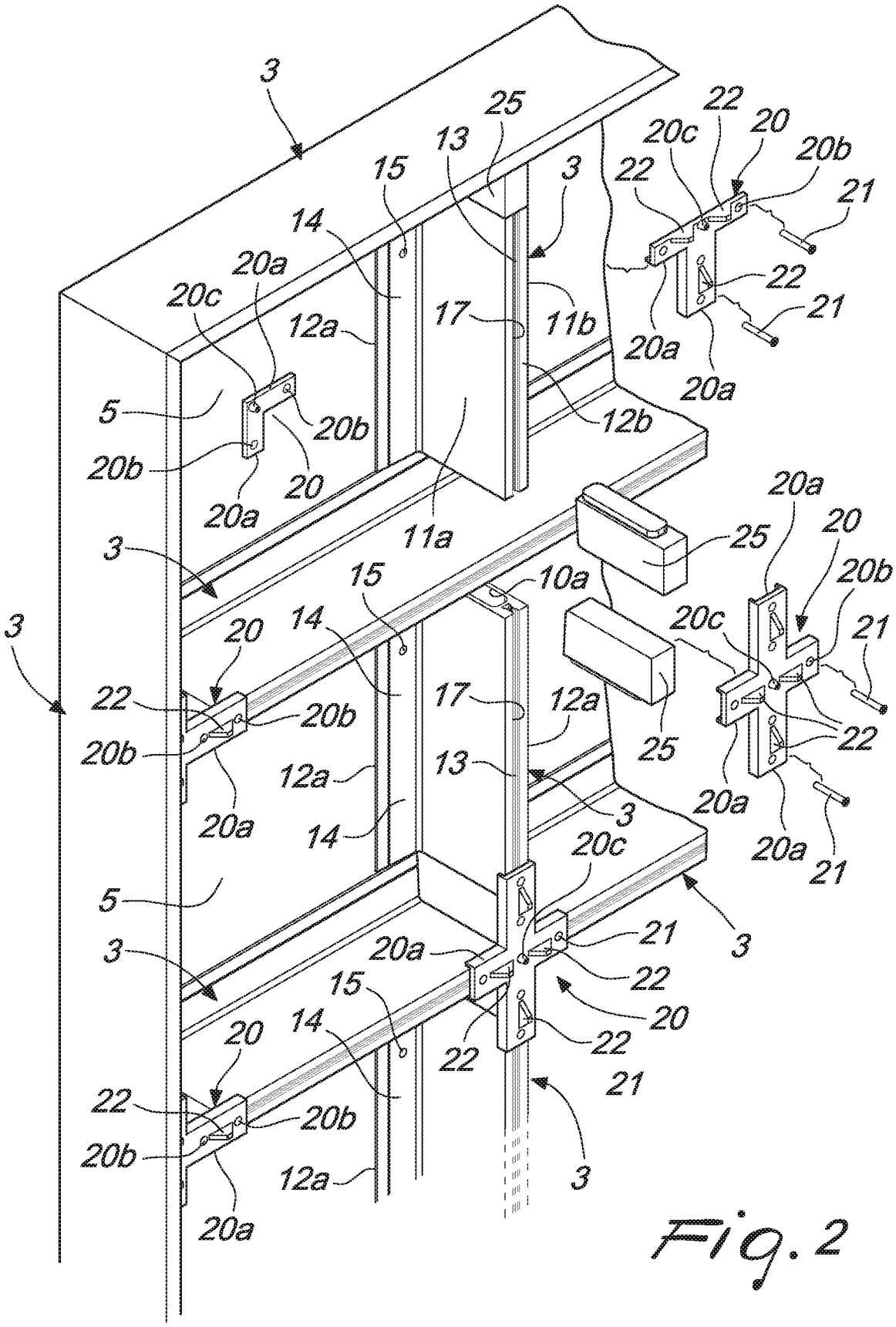
FIG. 2 is a partial perspective view of the base framework of the funerary structure according to the invention.

With reference to the figures, the funerary structure for containing funerary objects according to the invention, designated generally by the reference numeral 1, comprises a base frame 2 which is provided by means of a plurality of profiled elements 3, which are arranged along at least two directions, which are preferably but not necessarily mutually perpendicular and can be fixed to a supporting wall 4, which is for example substantially vertical, and are adapted to delimit laterally one or more containment recesses 5 for funerary objects, such as for example urns 6, photograph holders, vases, funerary lamps, and so forth.

The profiled elements 3 can be constituted conveniently by respective bars, obtained preferably by extrusion and conveniently made of metallic material or optionally plastic material or wood or other material.

The funerary structure according to the invention further comprises one or more slabs 7 for closing the recesses 5, which can be fixed, by virtue of fixing means 8, to the base framework 2 on the opposite side with respect to the supporting wall 4.

In practice, as can be seen from the figures, the recesses 5 have an extension along a respective axis which is substantially perpendicular to the supporting wall 4 and are delimited laterally, around their axis of extension, by multiple profiled elements 3, which thus provide the side walls of the recesses 5, while they are closed at one of their ends arranged along their axis of extension by the supporting wall 4 and at their opposite end, again along their axis of extension, by at least one of the slabs 7.

Figure 7:
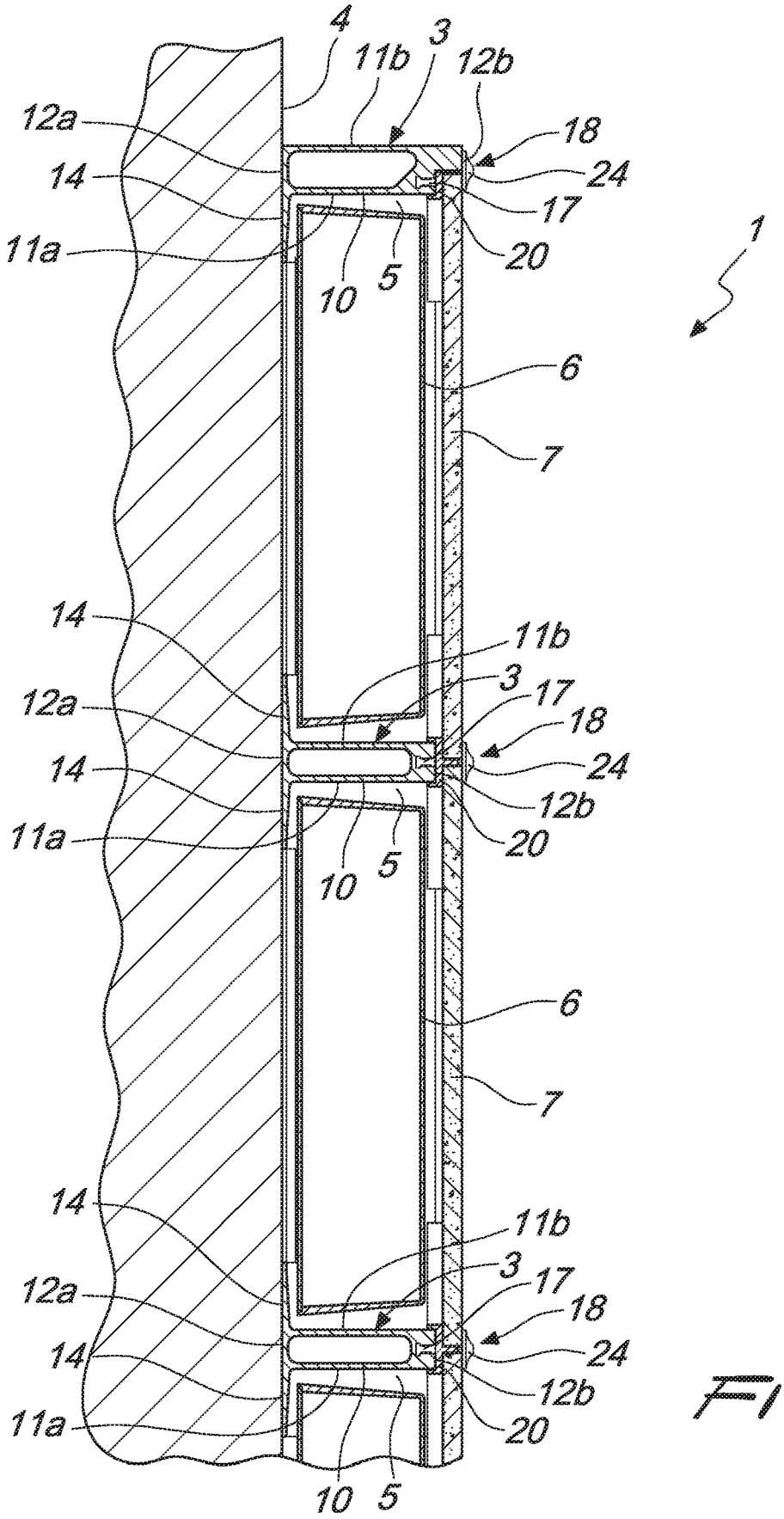
FIG. 7 is a partial and sectional view, taken along a vertical plane, of the funerary structure according to the invention.
Figure 8:
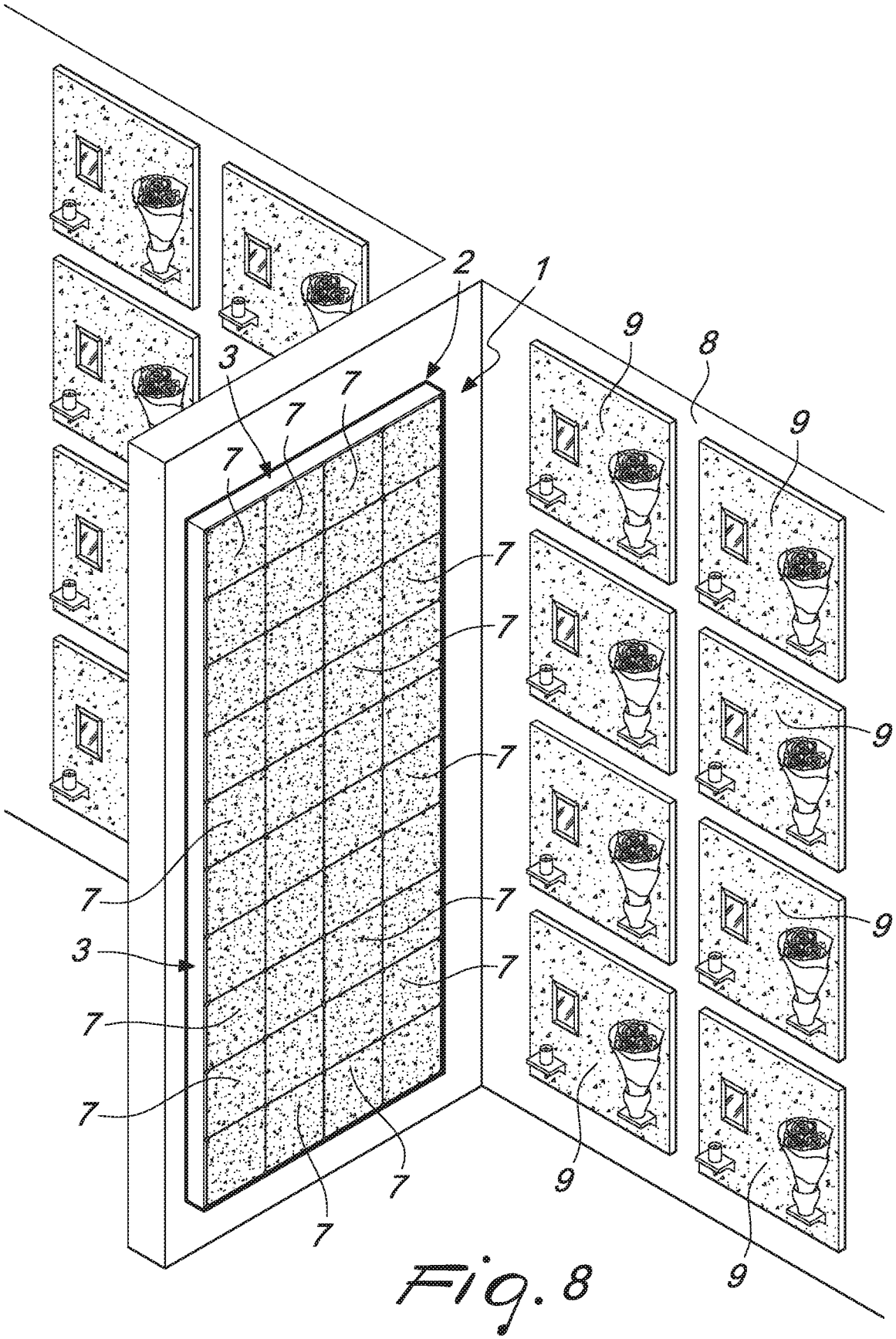
FIG. 8 is a perspective view of the funerary structure according to the invention arranged within a cemetery.
Figure 9:
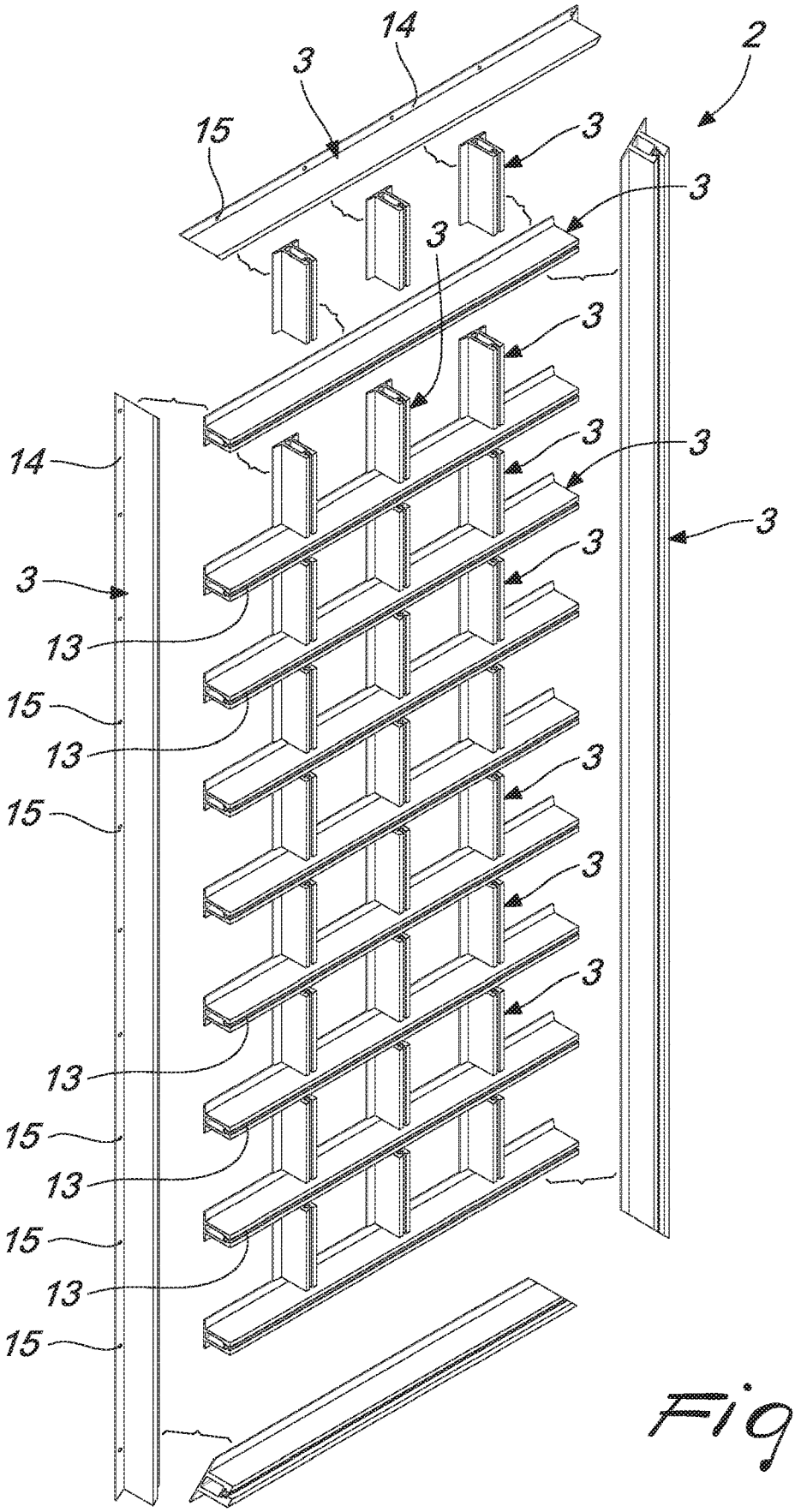
FIG. 9 is a perspective and partially exploded view of the base framework of the funerary structure according to the invention in a possible constructive variation.
Figure 10:
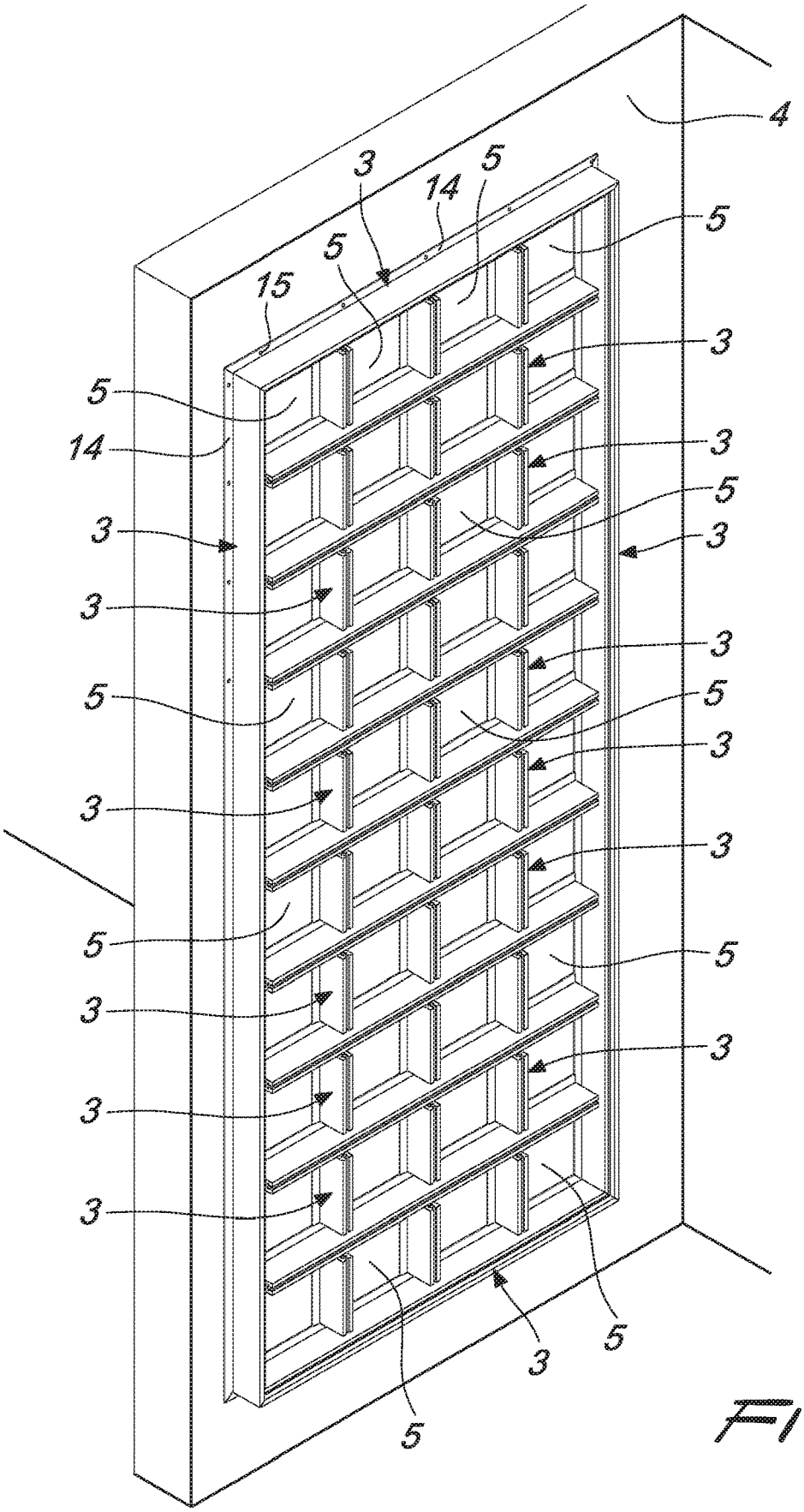
FIG. 10 is a perspective view of the base framework of the constructive variation of the funerary structure according to the invention, fixed to a supporting wall.
Figure 11:
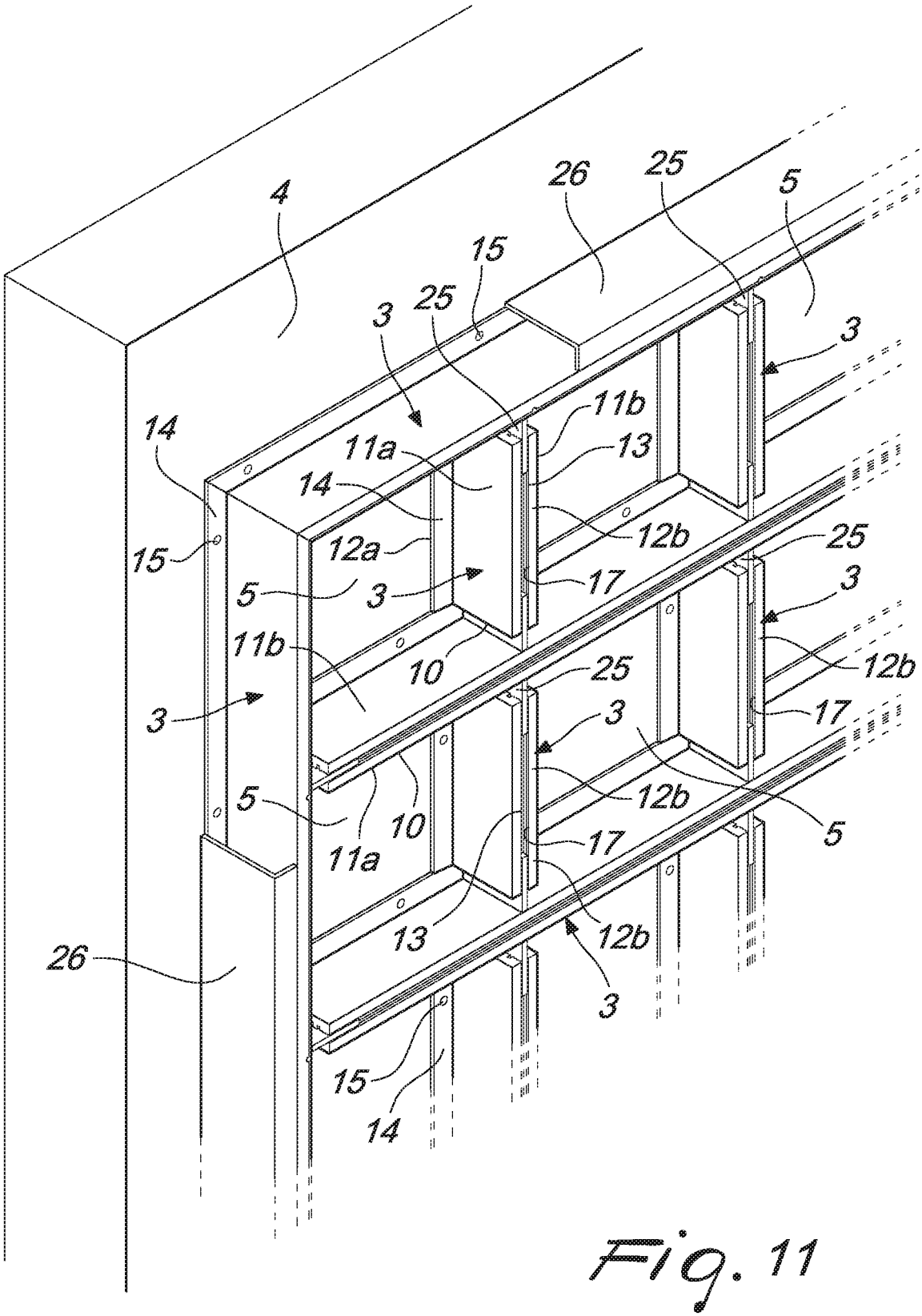
FIG. 11 is a partial view of the base framework of the constructive variation of the funerary structure according to the invention.
Figure 12:
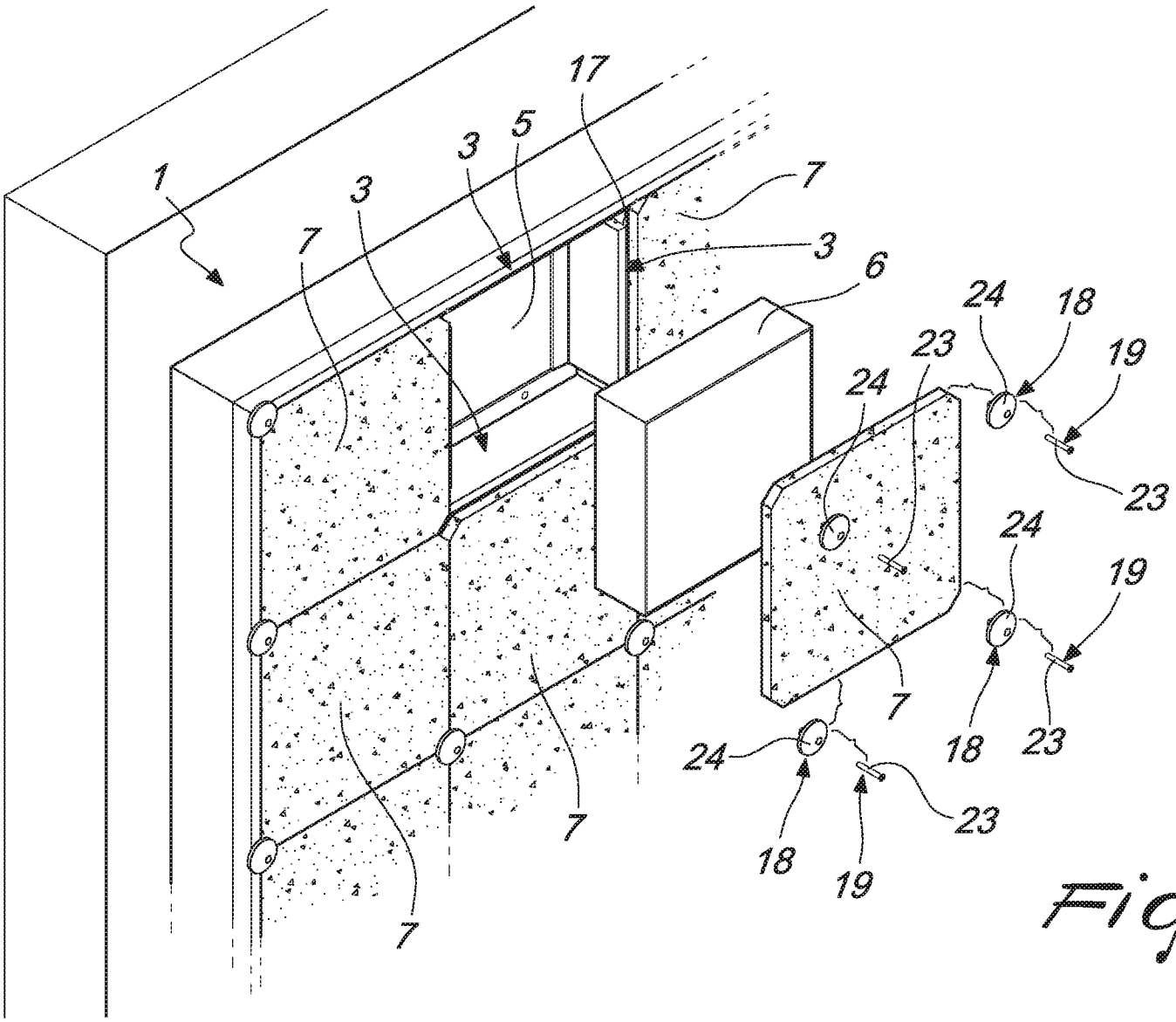
FIG. 12 is a partially exploded perspective view of a portion of the constructive variation of the funerary structure according to the invention.
Figure 13:
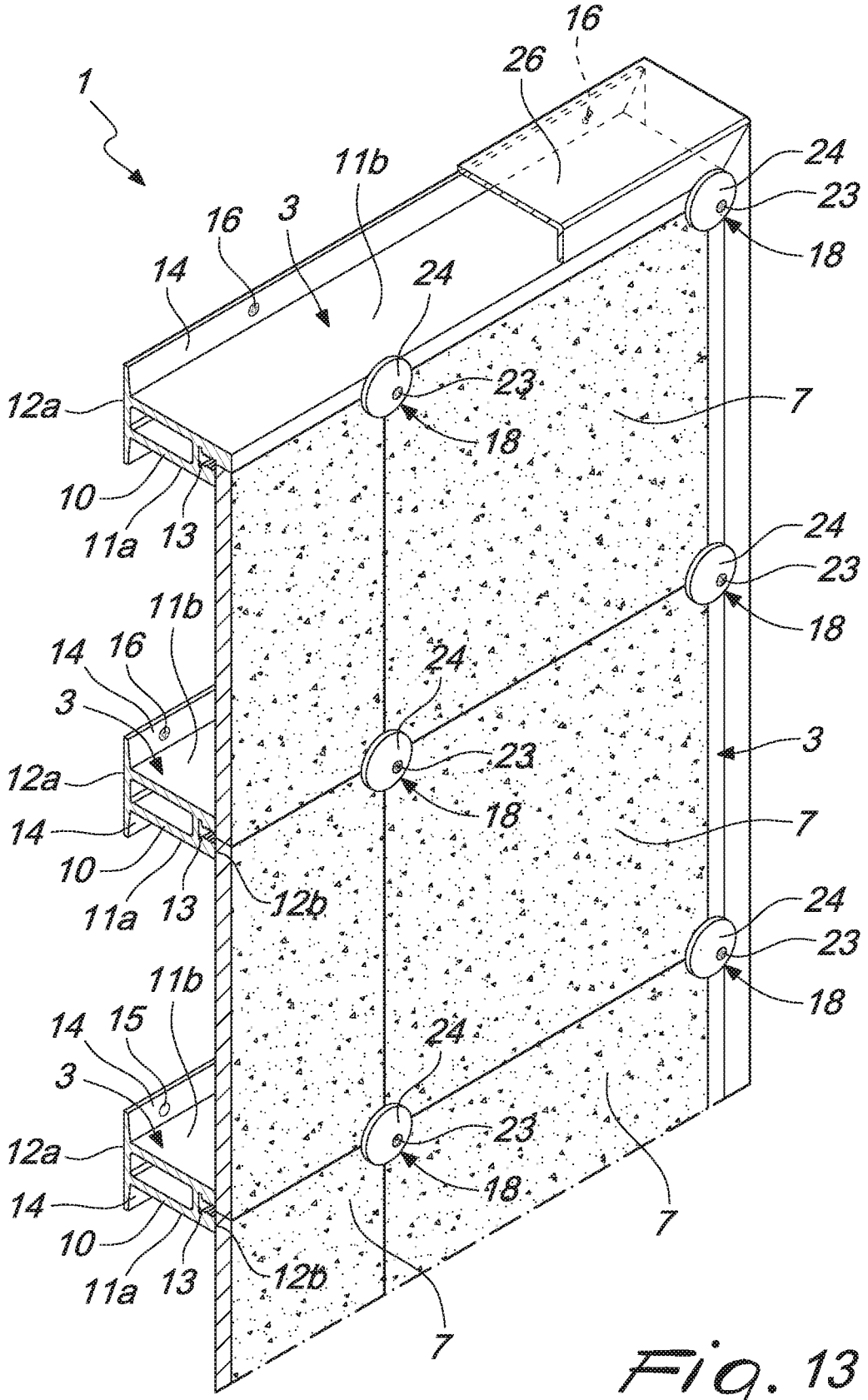
FIG. 13 is a perspective cutout view of the funerary structure according to the invention in the variation of FIG. 9.
Figure 14:
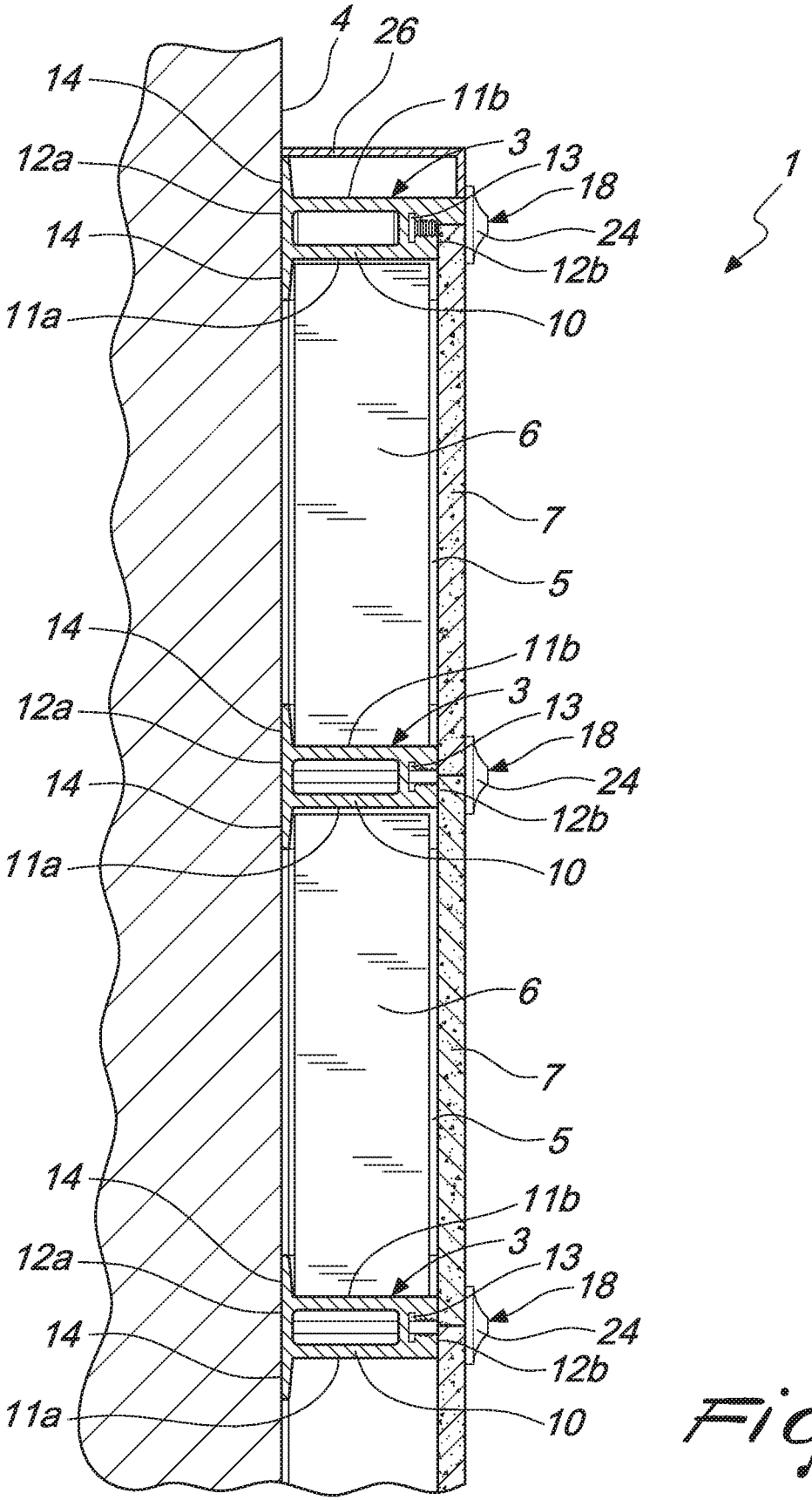
FIG. 14 is a sectional view, taken along a vertical plane, of a portion of the constructive variation of the funerary structure according to the invention.
Figure 15:
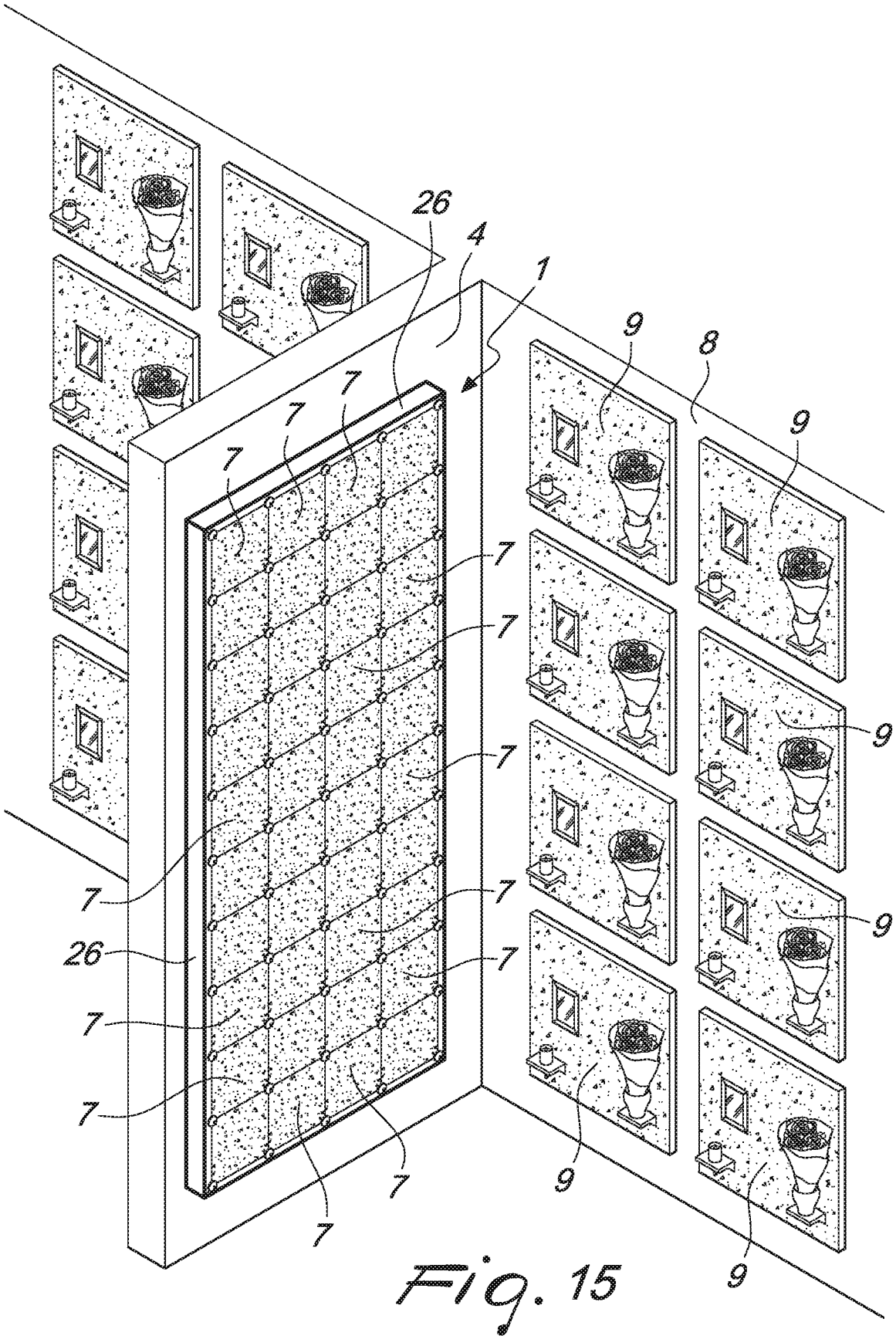
FIG. 15 is a perspective view of the constructive variation of the funerary structure according to the invention arranged within a cemetery.
Figure 16:
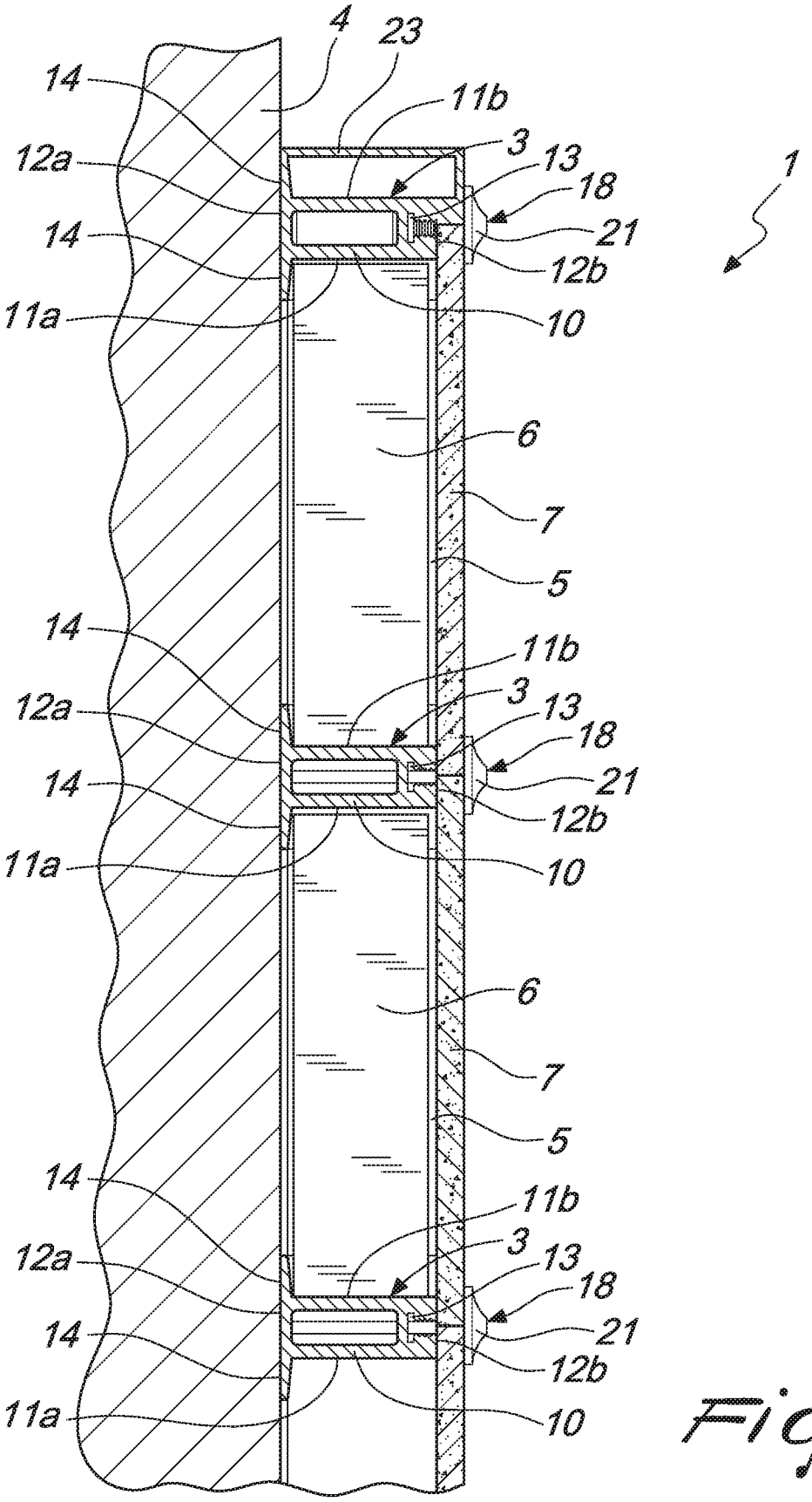
FIG. 16 is a sectional view of a further constructive variation of the funerary structure according to the invention, taken along a vertical plane.

In particular, the supporting wall 4 can be constituted conveniently by an existing wall made of masonry, concrete, plasterboard or other material of a cemetery or located at another site, for example an outdoor open site or a site that belongs to a cemetery, such as a park, a garden or the like. For example, the supporting wall 4 can be constituted by an existing dividing wall which is extended at right angles with respect to cemetery walls 8 provided with niches 9 of a mausoleum or of a cemetery, as shown in FIG. 7. As an alternative, the supporting wall 4 may also be a wall that is provided on purpose and can also be arranged independently, optionally located within a cemetery or in an open area of the cemetery or of another site, such as a park, a garden or the like.

The profiled elements 3 conveniently comprise at least one first group of profiled elements 3 which are designed to be arranged substantially parallel and spaced with respect to each other, substantially along at least one first direction, and at least one second group of profiled elements 3 which are designed to be arranged substantially parallel and spaced with respect to each other, substantially along at least one second direction, which is oriented substantially at right angles to the first direction.

For example, if the supporting wall 4 is extended substantially vertically, as in the illustrated examples, the profiled elements 3 of the first group are designed to be arranged substantially horizontally, at different height levels, while the profiled elements 3 of the second group are designed to be arranged substantially vertically.

Preferably, but not necessarily, the profiled elements 3 of the first group are longer than those of the second group.

In practice, multiple profiled elements 3 of the first group, which are mutually vertically spaced substantially uniformly along the vertical extension of the supporting wall 4, are fixed to the supporting wall 4, and multiple profiled elements 3 of the second group, uniformly mutually spaced along mutually parallel horizontal rows, are fixed between the profiled elements 3 of the first group, so as to obtain, in the spaces thus delimited by the profiled elements 3, recesses 5 which have a substantially quadrangular shape in transverse cross-section with respect to their axis of extension.

It should be noted that at the two right and left ends or sides of the base framework 2 it is possible to arrange conveniently two profiled elements 3 of the second group, i.e., arranged vertically, which have a length that is substantially equal to the height of the base framework 2, so as to define its perimeter laterally.

In greater detail, each one of the profiled elements 3 comprises a main body 10 which has a longitudinal extension and is provided with a pair of planar faces 11*a* and 11*b* which are mutually opposite and extended substantially parallel to the longitudinal axis of extension of the main body 10.

In particular, the planar faces 11*a* and 11*b* of the main body 10 of the profiled elements 3 are designed to be arranged substantially at right angles to the supporting wall 4 and at least one of them is designed to form, with at least one of its portions, at least one part of the lateral confinement wall of at least one of the recesses 5.

The main body 10 of the profiled elements 3 has, along a direction that is substantially transverse to its longitudinal axis and substantially parallel to its two planar faces 11*a* and 11*b*, a pair of longitudinal coupling edges, which are constituted respectively by a first longitudinal coupling edge, designated by 12*a*, which is designed to be directed toward the supporting wall 4 and has at least one portion for fixing to said supporting wall, and by a second longitudinal coupling edge 12*b*, which is designed to be directed toward the slabs 7 and is provided with at least one engagement region 13 for the means 8 for fixing the slabs 7 to the base framework 2 and/or for any auxiliary elements of the base framework 2.

For example, the fixing portion of the first longitudinal edge 12*a* of the main body 10 can be constituted by at least one wing 14, which protrudes laterally from the main body 10, along a direction that is substantially perpendicular to the planar faces 11*a* and 11*b* and is crossed by accommodation openings 15 for connecting bolts 16 which allow the anchoring of the wing 14 and therefore of the corresponding profiled element 3 to the supporting wall 4.

Advantageously, the engagement region 13 for the fixing means 8, which is arranged at the second longitudinal coupling edge 12*b* of the main body 10, is provided by at least one longitudinal slot 17, which is extended along the main body 10 of the profiled elements 3 and is open on the side of the second longitudinal coupling edge 12*b*.

Conveniently, the means 8 for fixing the slabs 7 comprise a plurality of locking elements 18, which engage the slabs 7 on their face 7*a* that is directed opposite with respect to the base framework 2, i.e., outward with respect to the recesses 5, and clamping elements 19, which are capable of acting on the locking elements 18 so as to produce the clamping of the slabs 7 between the locking elements 18 and the base framework 2.

Advantageously, it is possible to provide junction elements 20, which mutually connect at least two profiled elements 3 and each comprise at least two arms 20*a*, which are arranged angularly with respect to each other and can be fixed to respective profiled elements 3 by virtue of screw elements 21, which pass through engagement holes 20*b* formed in the junction elements 20 and capable of engaging in the longitudinal slots 17 of the profiled elements 3.

For example, it is possible to provide junction elements 20 which are L-shaped and provided with two arms 18*a* which are arranged at right angles to each other, junction elements 20 which are T-shaped with three arms 18*a*, of which two are mutually aligned and the third one is arranged at right angles to the first two, and junction elements 20 which are cross-shaped, with four arms 18*a* arranged along two perpendicular directions.

Advantageously, the junction elements 20 can have, on their face designs to be directed away from the profiled elements 3, abutment elements 22 which define abutment surfaces against which the edges of the slabs 7 can rest.

Conveniently, the clamping elements 19 are provided by screws 23, which can be screwed with their threaded stems either directly into the longitudinal slots 17 of the profiled elements 3 or in threaded holes 20*c* formed in the junction elements 20, while the locking elements 18 are conveniently provided by washers 24 or other similar elements, which are mounted on the screws 23 and are kept rested against the slabs 7 by the head of the screws 22.

It should be noted that conveniently the internal walls of the longitudinal slot 17 of the profiled elements 3 are shaped so as to be able to accommodate the thread of the screw elements 21 and of the screws 23.

Figure 3:
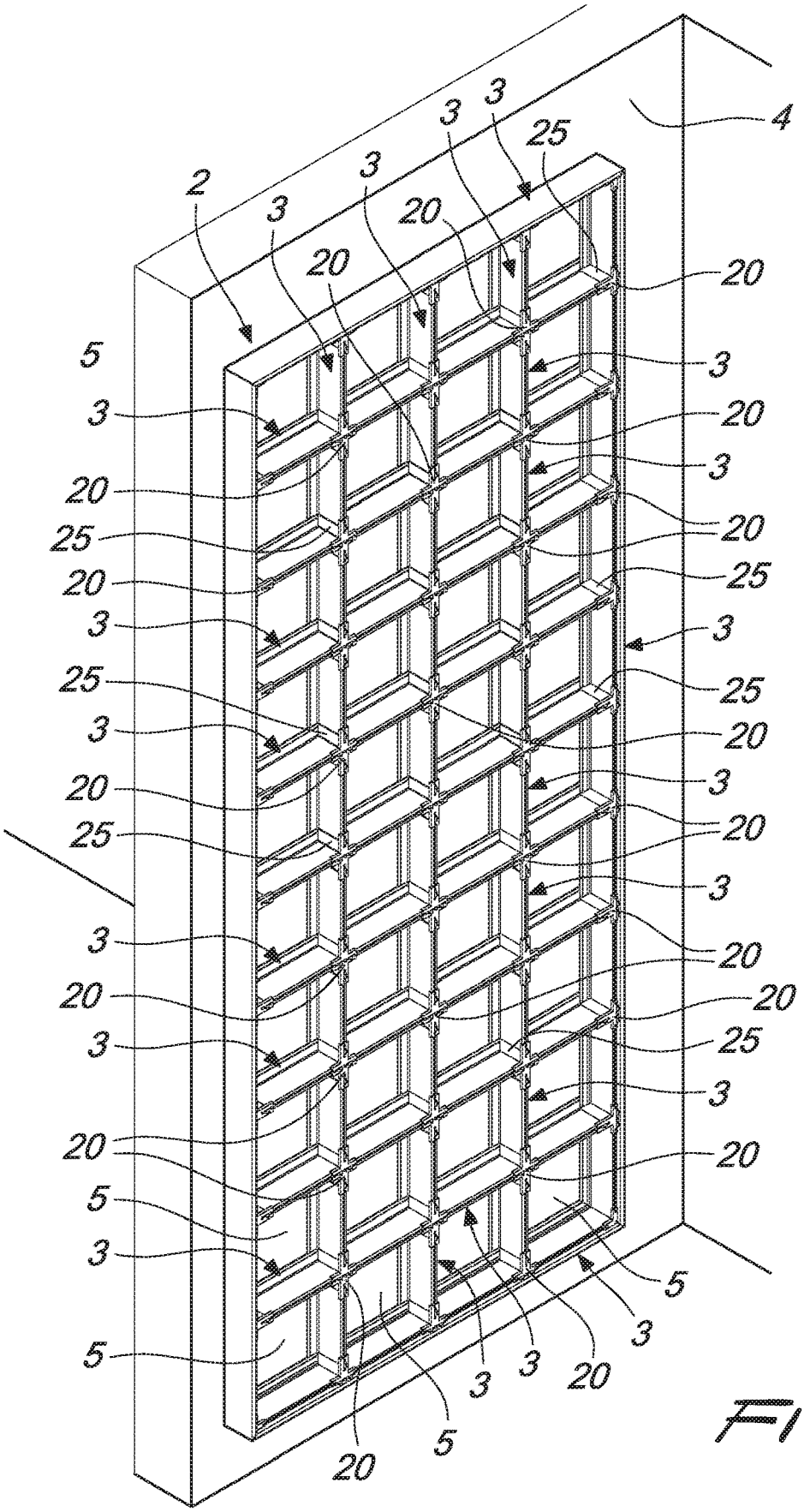
FIG. 3 is a perspective view of the base framework fixed to a supporting wall.
Figure 4:
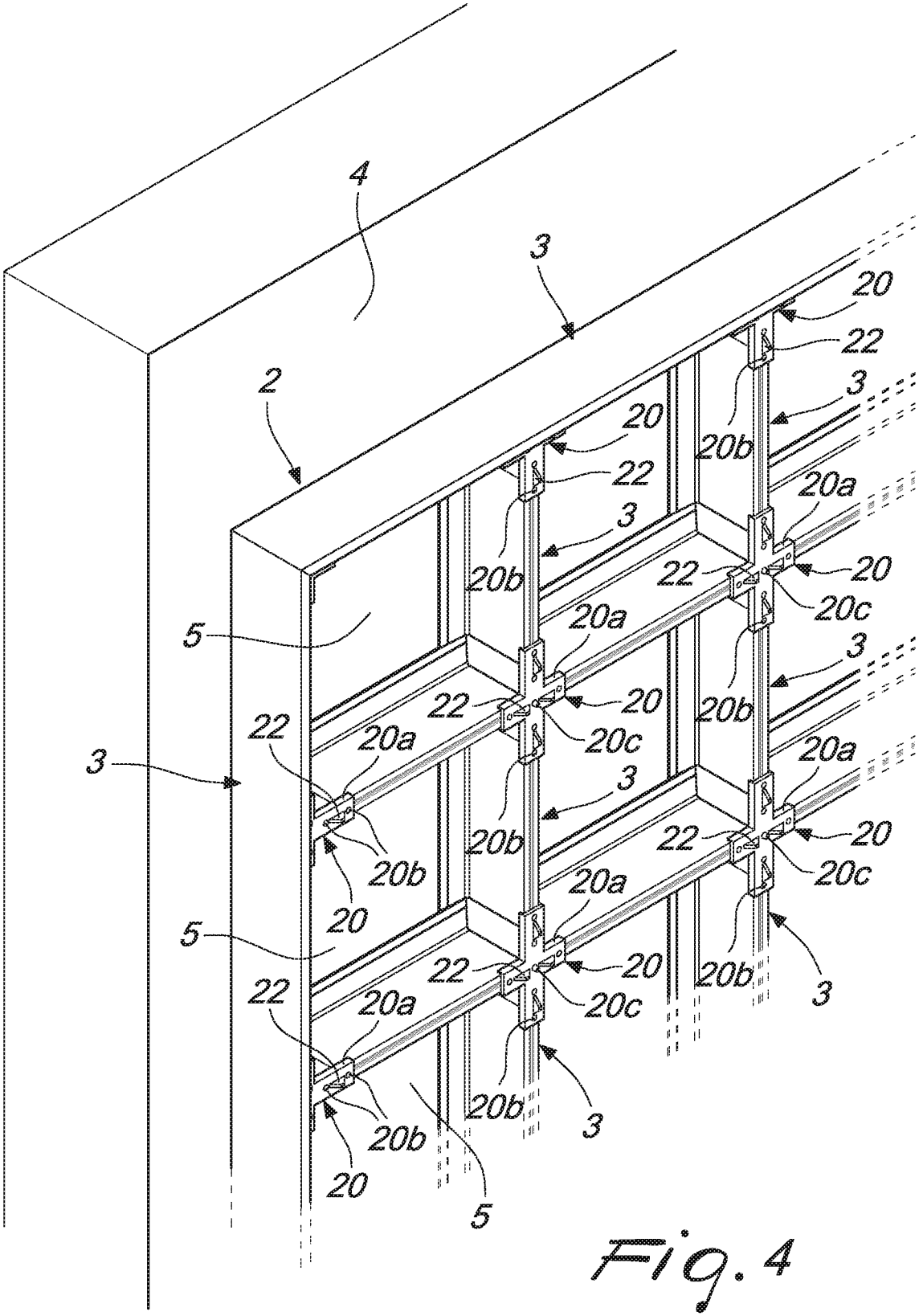
FIG. 4 is an enlarged-scale perspective view of a detail of FIG. 3.
Figure 5:
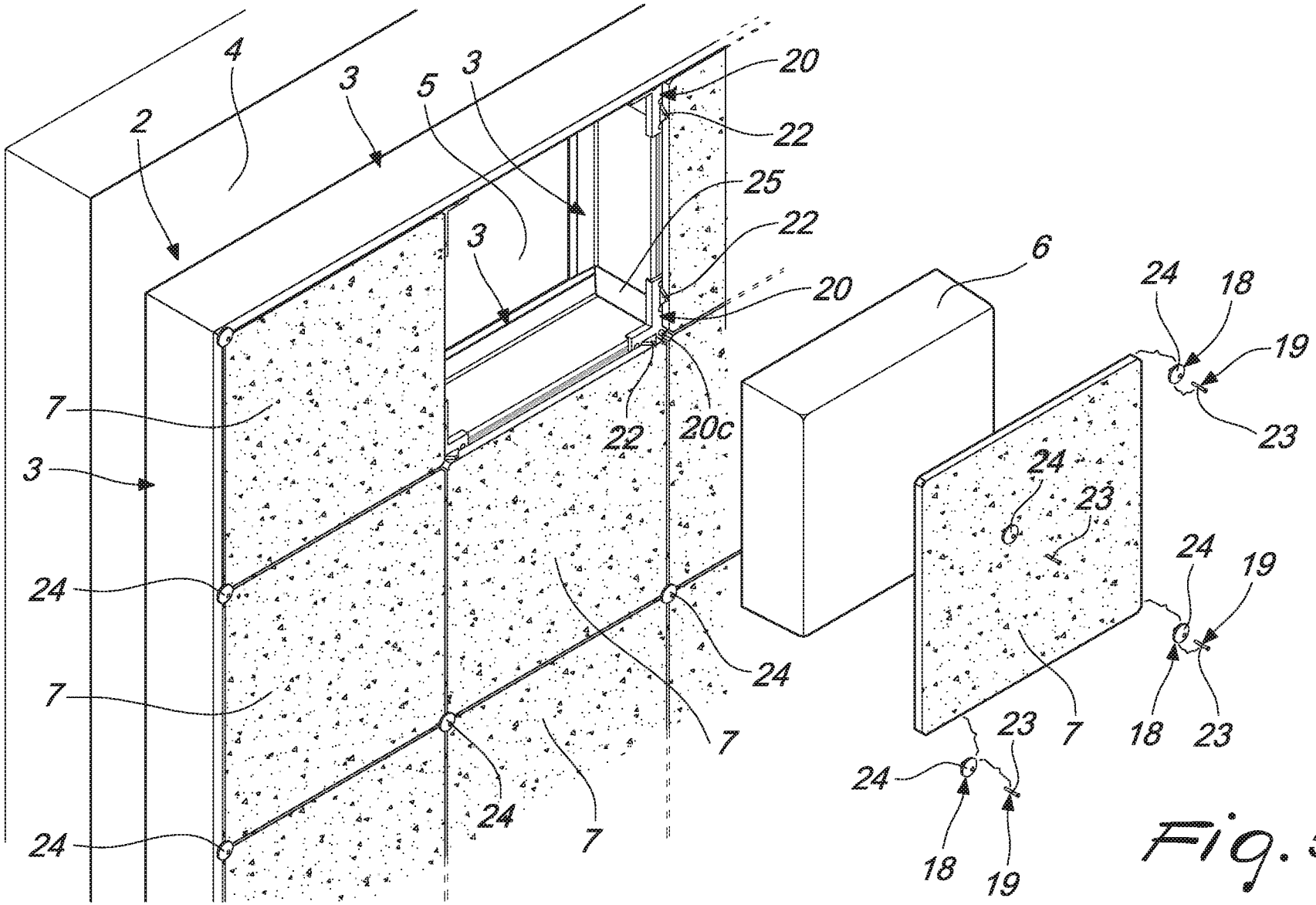
FIG. 5 is a partially exploded partial perspective view of the funerary structure according to the invention.
Figure 6:
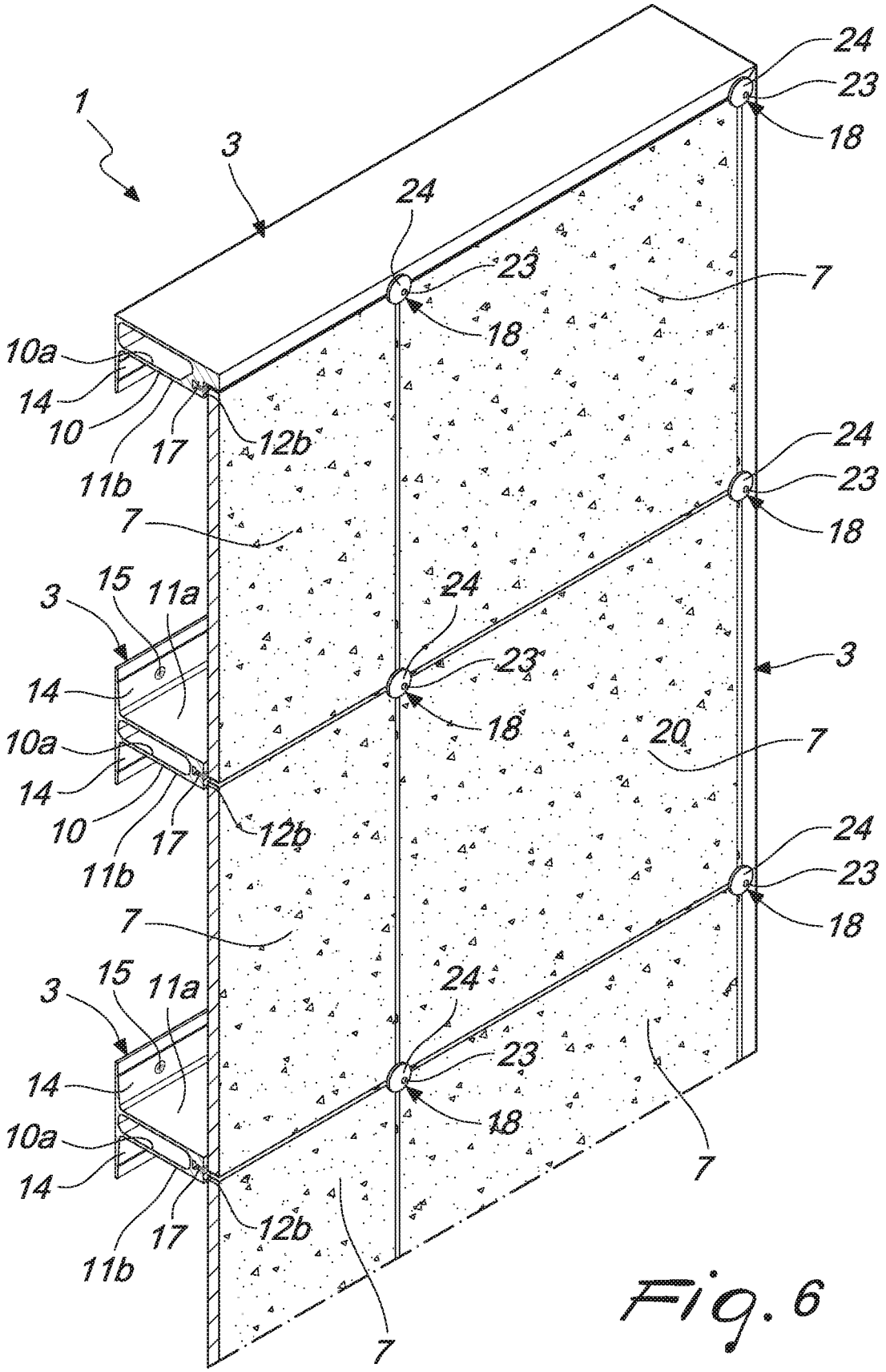
FIG. 6 is a sectional perspective view of a portion of the funerary structure according to the invention.

Advantageously, as shown in FIG. 3, in order to be able to fill any spaces between the ends of some profiled elements 3 and the profiled elements that are contiguous to them, there are connecting elements 25, made of elastically flexible material, which can be coupled to the profiled elements 3. In particular, said connecting elements 25 can, for example, be provided by laminas or blocks made of rubber or other similar material which can be inserted in the slots 17 of the profiled elements 3 and/or within an axial cavity 10*a* of the main body 10 of the profiled elements 3, so that they can protrude from the ends thereof so as to constitute in practice an axial extension thereof.

It should be added that around the base framework 2 it is possible to arrange a finishing border provided by adapted profiles 26, which can be coupled to the profiled elements 3 arranged at the peripheral region of the base framework 2. Nothing forbids the profiles 26 from being provided integrally, monolithically, with the profiled elements 3 arranged at the peripheral region of the base framework 2.

It is also possible to provide that at least the profiled elements 3 designed to be arranged at the peripheral region of the base framework 2 can have, along the second longitudinal edge 12*b*, a recessed portion, which is designed to be directed toward the inside of the base framework 2, in which the engagement region 13 is formed, and a raised portion, which is directed toward the outside of the base framework 2 and forms a lateral abutment border for the slabs 7.

In order to install the funerary structure, one proceeds with assembling the base framework 2 on the supporting wall 4, and in order to do this it is possible for example to proceed by initially applying to the supporting wall 4 a plurality of profiled elements 3 of the first group, fixing them by means of connecting bolts 16.

Then the profiled elements 3 of the second group are fixed to the supporting wall 4, again by means of connecting bolts 16, so as to delimit laterally a plurality of recesses 5 by means of the profiled elements 3 thus assembled.

It is optionally possible to complete the base framework 2 by applying to the profiled elements 3 arranged at the peripheral region of the base framework 2 the profiles 26.

Furthermore, it is possible to fix by means of the screw elements 21 the junction elements 20 between the profiled elements 3.

In the recesses 5 it is then possible to arrange funerary objects, such as for example urns 6 that conveniently have a shape that substantially corresponds to the shape of the recesses 5.

In order to close the recesses 5 on the opposite side with respect to the supporting wall 4, a plurality of slabs 7 is locked to the base framework 2, by virtue of the fixing means 8, at the open face of the recesses 5.

In particular, each slab 7 is rested against the profiled elements 3 that delimit the corresponding recess 5 or against the junction elements 20 and the corresponding abutment elements 22, the stems of the screws 23 are inserted in the spaces left by the beveled corners of the slabs 7, and the screws 23 are screwed into the longitudinal slots 17 of the profiled elements 3 or in the threaded holes 20*c* of the junction elements 20, so as to clamp the washers 24 against the slabs 7.

It should be noted that by virtue of the fact that it is provided by means of profiled elements 3, the space occupation along the direction that is perpendicular to the supporting wall of the funerary structure according to the invention and in particular of the base framework 2 is extremely smaller than currently known funerary structures, even of the modular type, and is such as to allow the placement of the funerary structure according to the invention in the space that is present between a supporting wall 4 and the closest vertical row of burial niches 9 of a contiguous cemetery wall. For example, the space occupation along the direction that is perpendicular to the supporting wall 4 of the funerary structure according to the invention can be comprised between 80 and 150 mm.

In practice it has been found that the invention achieves the intended aim and objects, providing a funerary structure for containing funerary objects that allows to utilize validly all the spaces available in cemeteries.

The invention thus conceived is susceptible of numerous modifications and variations, all of which are within the scope of the appended claims Thus, for example, nothing forbids the supporting wall 4 from extending, instead of on a substantially vertical plane, as in the examples described above, on a substantially horizontal plane, and in this case can be constituted by a paving surface or by a surface arranged below a paving surface, which already exist in a cemetery or are provided on purpose, in a cemetery or other site, even an open one, such as a park, a garden or the like.

Furthermore, all the details may be replaced with other technically equivalent elements.

In practice, the materials used, so long as they are compatible with the specific use, as well as the contingent shapes and dimensions, may be any according to the requirements and the state of the art.

The disclosures in Italian Patent Application No. 102018000005885 from which this application claims priority are incorporated herein by reference.

The invention claimed is:

1. A funerary structure for containing funerary objects, comprising:

a base framework provided with a plurality of profiled elements which are arranged along at least two directions and can be fixed to a supporting wall, said profiled elements being adapted to delimit laterally at least one containment recess for said funerary objects;

at least one slab for closing said at least one recess being provided and being fixable by a fixing means to said base framework on the opposite side with respect to said supporting wall; and connecting elements made of elastically flexible material which are coupled to said profiled elements in order to fill any spaces between the adjacent profiled elements.

2. The funerary structure according to claim 1, wherein said profiled elements are adapted to delimit laterally a plurality of said recesses, a plurality of said slabs for closing said recesses being provided.

3. The funerary structure according to claim 1, further comprising at least one first group of said profiled elements designed to be arranged substantially parallel and mutually spaced substantially along at least one first direction and at least one second group of said profiled elements designed to be arranged substantially parallel and mutually spaced substantially along at least one second direction, which is substantially perpendicular to said at least one first direction.

4. The funerary structure according to claim 1, wherein said supporting wall is extended substantially vertically, said profiled elements of at least one first group being designed to be arranged substantially horizontally, at different height levels, said profiled elements of at least one second group being designed to be arranged substantially vertically.

5. The funerary structure according to claim 1, wherein each one of said profiled elements comprises a longitudinally extended main body provided with a pair of mutually opposite planar faces, which are extended substantially parallel to the axis of longitudinal extension of said main body and are designed to be arranged substantially at right angles to said supporting wall, at least one of said planar faces being designed to form, with at least one portion of said at least one of said planar faces, at least one part of a side wall of said at least one recess.

6. The funerary structure according to claim 5, wherein said main body has, along a direction which is substantially transverse with respect to the axis of longitudinal extension and is substantially parallel to said planar faces, a pair of longitudinal coupling edges, respectively a first longitudinal coupling edge, designed to be directed toward said supporting wall and provided with at least one fixing portion for fixing to said supporting wall, and a second longitudinal coupling edge, which is designed to be directed toward said slabs and has at least one engagement region for said fixing means and/or for auxiliary elements of said base framework.

7. The funerary structure according to claim 6, wherein said at least one engagement region comprises at least one longitudinal slot, said fixing means comprising locking elements which engage said slabs on their face directed away from said base framework and clamping elements which are adapted to produce the clamping of said slabs between said locking elements and said base framework.

8. The funerary structure according to claim 5, wherein at least one fixing portion comprises at least one wing which protrudes laterally from said main body substantially at right angles to said planar faces and is crossed by accommodation openings for bolts for connection to said supporting wall.

9. The funerary structure according to claim 7, wherein said clamping elements comprise respective screws, said locking elements comprising washers mounted on said screws.

10. The funerary structure according to claim 1, wherein said supporting wall comprises an existing wall of a cemetery or other site.

11. A funerary structure for containing funerary objects, comprising:

a base framework provided with a plurality of profiled elements which are arranged along at least two directions and can be fixed to a supporting wall, said profiled elements being adapted to delimit laterally at least one containment recess for said funerary objects;

at least one slab for closing said at least one recess being provided and being fixable by a fixing means to said base framework on the opposite side with respect to said supporting wall, wherein each one of said profiled elements comprises a longitudinally extended main body provided with a pair of mutually opposite planar faces, which are extended substantially parallel to the axis of longitudinal extension of said main body and are designed to be arranged substantially at right angles to said supporting wall, at least one of said planar faces being designed to form, with at least one portion of said at least one of said planar faces, at least one part of a side wall of said at least one recess, and wherein said main body has, along a direction which is substantially transverse with respect to the axis of longitudinal extension and is substantially parallel to said planar faces, a pair of longitudinal coupling edges, respectively a first longitudinal coupling edge, designed to be directed toward said supporting wall and provided with at least one fixing portion for fixing to said supporting wall, and a second longitudinal coupling edge, which is designed to be directed toward said slabs and has at least one engagement region for said fixing means and/or for auxiliary elements of said base framework.

12. A funerary structure for containing funerary objects, comprising:

a base framework provided with a plurality of profiled elements which are arranged along at least two directions and can be fixed to a supporting wall, said profiled elements being adapted to delimit laterally at least one containment recess for said funerary objects;

at least one slab for closing said at least one recess being provided and being fixable by a fixing means to said base framework on the opposite side with respect to said supporting wall wherein each one of said profiled elements comprises a longitudinally extended main body provided with a pair of mutually opposite planar faces, which are extended substantially parallel to the axis of longitudinal extension of said main body and are designed to be arranged substantially at right angles to said supporting wall, at least one of said planar faces being designed to form, with at least one portion of said at least one of said planar faces, at least one part of a side wall of said at least one recess, and wherein at least one fixing portion comprises at least one wing which protrudes laterally from said main body substantially at right angles to said planar faces and is crossed by accommodation openings for bolts for connection to said supporting wall.

* * * * *